US006294067B1

(12) United States Patent
Gauthier et al.

(10) Patent No.: US 6,294,067 B1
(45) Date of Patent: Sep. 25, 2001

(54) 3 COMPONENT CATHODE COLLECTOR BAR

(75) Inventors: Claude Gauthier, Sante-Foy; Claude Fradet, Chicoutimi; Marc Dupuis, Jonquière; Daniel Richard, Quebec, all of (CA)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/590,199

(22) Filed: Jun. 8, 2000

Related U.S. Application Data

(60) Provisional application No. 60/193,081, filed on Mar. 30, 2000.

(51) Int. Cl.[7] ..... C25C 3/06
(52) U.S. Cl. ..... 205/372; 204/243.1; 204/280
(58) Field of Search ..... 204/243.1, 280; 205/372

(56) References Cited

U.S. PATENT DOCUMENTS

| | | | |
|---|---|---|---|
| 3,499,831 | 3/1970 | McMinn et al. | 204/243 |
| 3,551,319 | 12/1970 | Elliott | 204/243 |
| 4,795,540 | 1/1989 | Townsend | 204/243 R |
| 5,538,607 | 7/1996 | Pate | 204/280 |
| 5,597,461 | 1/1997 | Pate | 204/286 |
| 5,855,758 | 1/1999 | Mitchell et al. | 205/372 |
| 5,976,333 | 11/1999 | Pate | 204/279 |

*Primary Examiner*—Kathryn Gorgos
*Assistant Examiner*—Thomas H Parsons
(74) *Attorney, Agent, or Firm*—Julie W. Meder; Glenn E. Klepac

(57) ABSTRACT

A cathode assembly for use in a Hall-Heroult electrolytic cell, the assembly including a cathode block which receives two primary cathode collector bars and one secondary cathode collector bar disposed therebetween. The primary collector bars each have an electrical interface with the cathode block which is sized to be equal to or greater than an electrical interface between the secondary collector bar and the cathode block. The primary collector bars are electrically connected to the cathode block only along an interior portion of the cathode block and the secondary collector bar is fully connected to the cathode block. This arrangement improves current distribution through the cathode assembly by minimizing the amount of current passing through the ends of the cathode block.

23 Claims, 10 Drawing Sheets

3 COMPONENT CATHODE COLLECTOR BAR

RELATED APPLICATION

The present application claims the benefit of U. S. Provisional Application No. 60/193,081 filed Mar. 30, 2000 entitled "3 Component Cathode Collector Bar".

BACKGROUND OF THE INVENTION

1. Field of the Invention

The present invention relates to cathode assemblies for use in Hall-Heroult aluminum reduction cells. Such cathode assemblies include a cathode block into which is fitted a collector bar. More particularly, the invention relates to cathode assemblies having multiple collector bars.

2. Description of the Related Art

Aluminum is commonly manufactured via a smelting process in an electrolytic cell of the established Hall-Heroult design. A conventional Hall-Heroult electrolytic cell, known as a pot and shown in FIG. 1, includes a cell C defining a chamber H in which are received carbonaceous anodes A. The anodes A are suspended in a bath B of electrolytic fluid containing alumina and other materials. Electric current is supplied to the anodes A via anode rod assemblies R to provide a source of electrons for reducing the alumina to aluminum which accumulates as a molten aluminum pad P. The molten aluminum pad P forms a liquid metal cathode. A cathode assembly CA, shown in detail in FIG. 2 from the underside thereof, is positioned in the bottom of the chamber H and completes the cathodic portion of the cell C. The cathode assembly CA includes a carbonaceous cathode block CB having an upper surface which supports the molten aluminum pad P and a lower surface which defines a groove or slot S extending between the ends of the cathode block CB. A collector bar BA, typically formed from hot rolled or cast mild steel, is received within the slot S and is secured in the slot S with a layer of a conductive material CM such as cast iron, carbonaceous glue, rammed carbonaceous paste or the like. The conductive material layer CM is disposed between the collector bar BA and the cathode block CB along the entire length of the slot S. The collector bar BA is longer than the cathode block CB and extends out of the chamber H. The exposed end of the collector bar BA is connected via a bus bar (not shown) to the current supply in a conventional manner to complete the circuit. The cathode assembly CA may include a pair of opposing collector bars BA as shown in FIG. 2 which are separated by a filler material F which fills the gap between the collector bars BA. The filler material F may be a crushable material or a piece of carbon or a carbonaceous paste, commonly referred to as seam mix or ramming paste (an unfired mixture of anthracite or graphite and anthracite and pitch binder), or a combination thereof These electrolytic cells are typically operated at high temperatures (about 940 to 980° C.) which, when combined with the corrosive nature of the electrolytes, creates a harsh environment. Collector bars conventionally are formed from hot rolled or cast mild steel. Mild steel has relatively poor conductivity compared to aluminum, but has a high melting point and relatively low cost. The cathode blocks have historically been formed from a mixture of anthracite and pitch binder and exhibit relatively high electrical resistivity, high sodium swelling, low thermal shock resistance and high abrasion resistance. As aluminum producers have sought to increase productivity, the operating amperages for such cells have been increased; hence the need for reduced power losses in the smelting process has increased. In an effort to reduce the electrical resistivity, graphite has been substituted for some of the anthracite in the cathode blocks, however with concomitant loss in abrasion resistance, increased erosion rates and higher cost of materials. Moreover, cathode blocks with high graphite content and cathode blocks that have undergone a graphitizing process are subject to uneven cathode current distribution along the length of the cathode block and high localized erosion rates.

An electrical current passing through an object naturally follows the path of least resistance. In the case of a Hall-Heroult cell, this is believed to be through the outer one-third of the cathode block CB. The lines D in FIG. 1 depict the uneven distribution of current passing through the cathode block CB and the high concentration of current passing through the outer one-third of the cathode block CB. This high concentration of current in the cathode block CB results in increased localized erosion rates in that portion of the cathode block CB.

Accordingly, a need remains for a device for and a method of improving the current distribution in cathode blocks of a Hall-Heroult electrolytic cell which permits high graphite content and graphitized cathode blocks to be operated at high amperage with an improved pot life expectation.

SUMMARY OF THE INVENTION

This need is met by the cathode assembly of the present invention which is designed for use in a Hall-Heroult electrolytic cell for the production of aluminum. The cell includes a shell defining a chamber, an anode received in the chamber and a current bus positioned outside the shell and connected to the cathode assembly.

The cathode assembly of the present invention includes a cathode block positioned in the chamber below the anode, the cathode block defining at least two first slots and at least one second slot. The first and second slots extend from an external end of the cathode block to an interior portion of the cathode block. A primary collector bar is received in each of the first slots and has a primary interface for electrical connection to the cathode block. A secondary collector bar is received in the second slot and has a secondary interface for electrical connection to the cathode block. A combination of the primary interfaces is sized to be larger (have a greater surface area) than the secondary interface. Preferably, each of the primary interfaces are larger than the secondary interface. More preferably, the cross-sectional area of the primary collector bars is greater than the cross-sectional area of the secondary collector bar and each of the primary collector bars has a width greater than its height. The primary interface includes a connected portion of an exterior surface of the primary collector bar which is electrically connected to the cathode block whereas an unconnected portion of the primary collector bar exterior surface is electrically disconnected from the cathode block. The secondary interface includes an exterior surface of the secondary collector bar which extends substantially the full length of the portion of the secondary collector bar received in the second slot. In this manner, current may pass from the cathode block to the entire secondary collector bar but current can only pass from the cathode block to the primary collector bar at the interior of the cathode block.

This arrangement is preferably accomplished by including a layer of an electrically conductive material along the exterior surface of the primary collector bar adjacent the interior portion of the cathode block and along substantially the entire exterior surface of the secondary collector bar which is received in the second slot. The electrically conductive material may be cast iron, carbonaceous glue or rammed carbonaceous paste or the like. Preferably, the connected portion of the primary collector bar exterior surface extends between an interior of the cathode block and a position spaced from the external end of the cathode block. More preferably, the connected portion extends along about two-thirds of the length of the first slot.

The cathode assembly of the present invention is particularly useful for producing aluminum in a cell having a chamber containing an electrolytic bath and an anode suspended in the bath, where the current distribution through the cathode assembly is uniform. A method of producing aluminum according to the present invention includes steps of:

(a) providing a cathode assembly in the chamber below the anode, the cathode assembly having (1) a cathode block defining at least two first slots and at least one second slot, the first and second slots extending from an external end of the cathode block to an interior portion of the cathode block, (2) at least two primary collector bars, each primary collector bar being received in one of the first slots and having a primary interface for electrical connection to the cathode block and (3) at least one secondary collector bar received in the second slot and having a secondary interface for electrical connection to the cathode block, wherein the combination of the primary interfaces is larger than the secondary interface; and (b) passing an electric current from the anode to the cathode assembly thereby controlling the amount of current passing to the primary collector bars relative to the amount of current passing to the secondary collector bar.

An even current distribution may be accomplished by passing current from the anode to only a connected portion of the exterior surface of the primary collector bars adjacent the interior portion of the cathode block and to substantially all of the exterior surface of the secondary collector bar. This method further includes steps of electrically connecting substantially all of the exterior surface of the secondary collector bar to the cathode block and electrically connecting the connected portion of the exterior surface of the primary collector bar to the cathode block. In this manner, current is prevented from passing from the cathode block to the exterior surfaces of the primary collector bars adjacent the external ends of the cathode block.

A complete understanding of the invention will be obtained from the following description when taken in connection with the accompanying drawing figures wherein like reference characters identify like parts throughout.

DETAILED DESCRIPTION OF THE PREFERRED EMBODIMENTS

Figure 1:
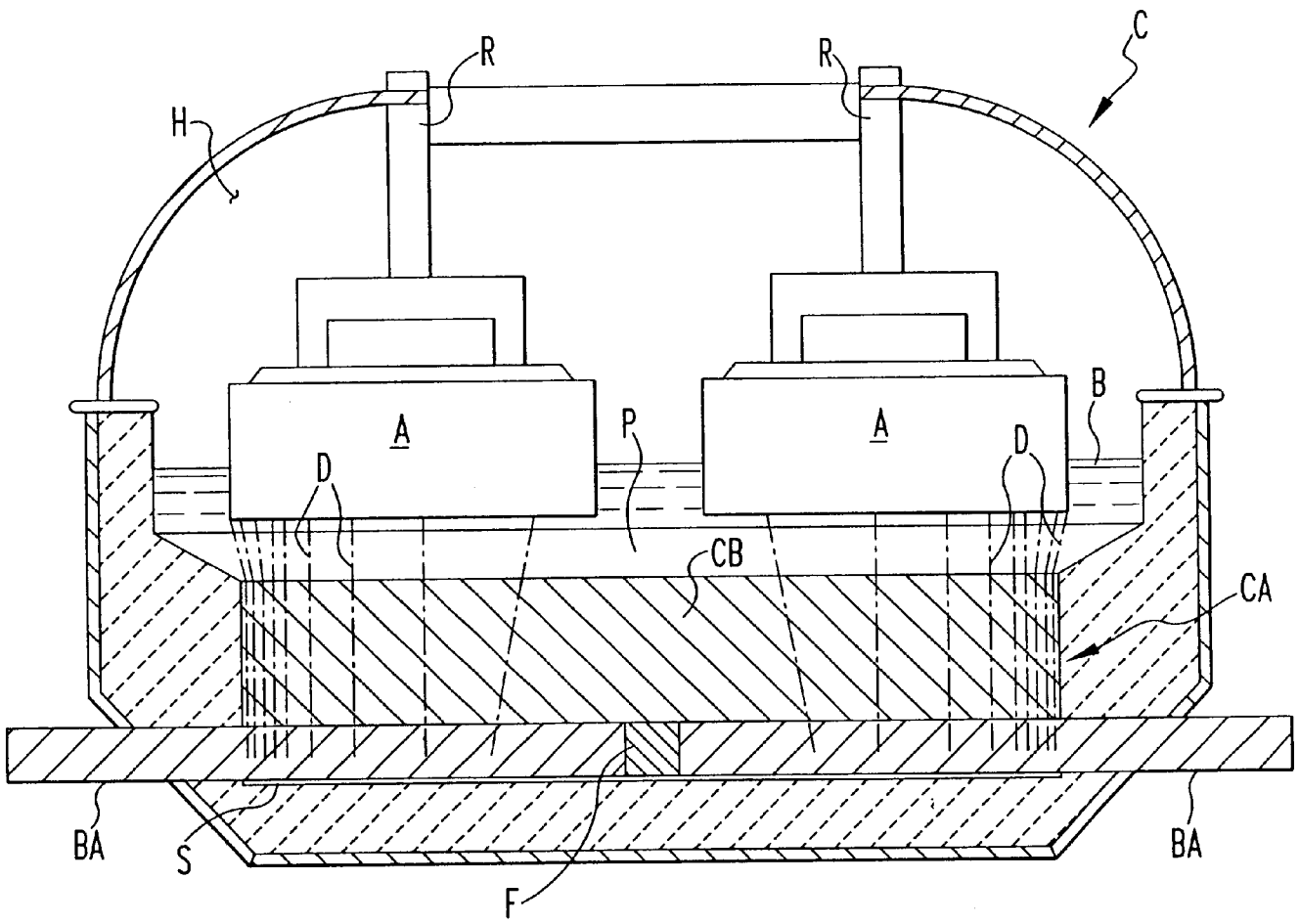
FIG. 1 PRIOR ART
FIG. 1 is a cross-sectional view of a portion of an aluminum electrolytic reduction cell of the prior art employing a conventional cathode block with collector bars.
Figure 2:
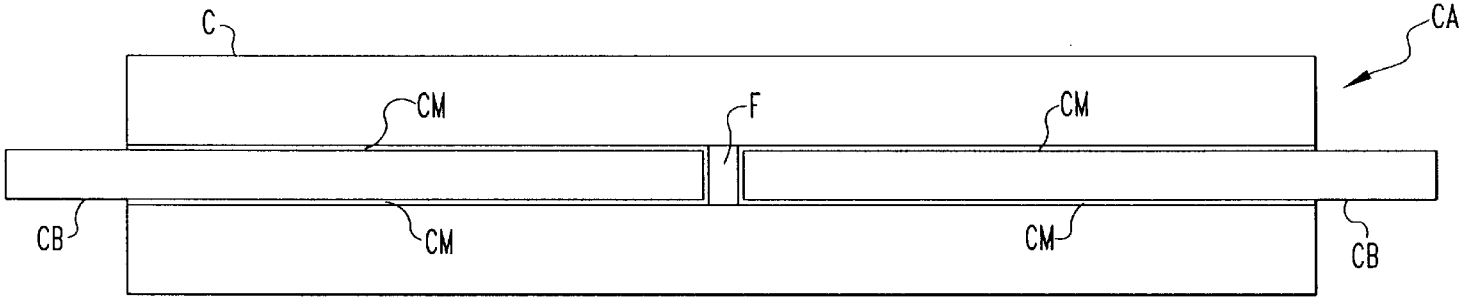
FIG. 2 PRIOR ART
FIG. 2 is a plan view of the underside of the cathode block and collector bars shown in FIG. 1.

For purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification are simply exemplary embodiments of the invention. Hence, specific dimensions and other physical characteristics related to the embodiments disclosed herein are not to be considered as limiting.

Figure 3:
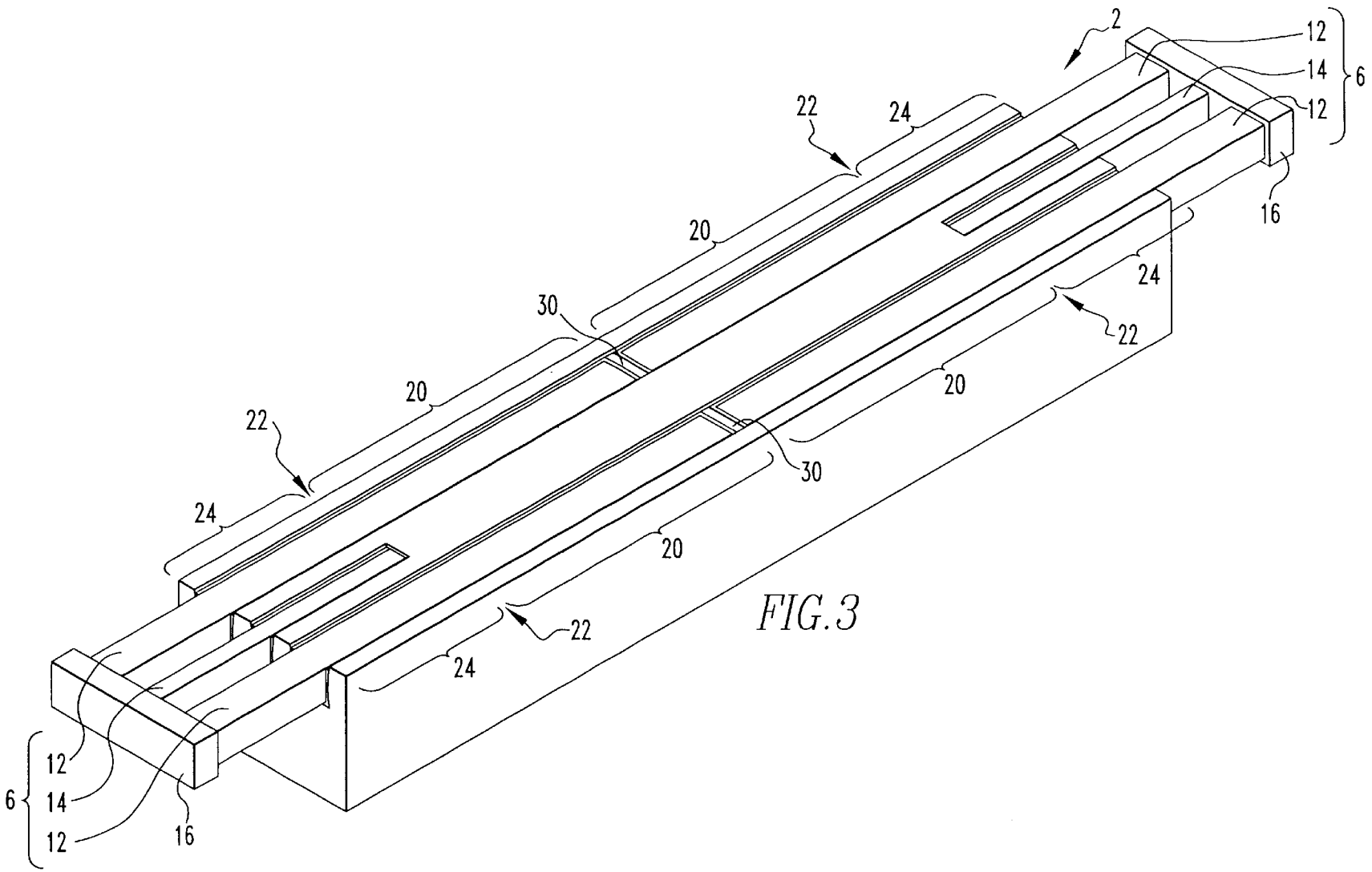
FIG. 3 is a perspective view of the underside of a cathode assembly made in accordance with the present invention having a cathode block and multiple collector bars.

As shown in FIG. 3, the cathode assembly 2 of the present invention is intended for use in a Hall-Heroult electrolytic cell for the production of aluminum and includes a cathode block 4 and a multi-piece collector bar assembly 6. For ease of description, FIGS. 3—7 show the cathode assembly of the present invention and its components as viewed from the underside of the cathode assembly 2.

Figure 4:
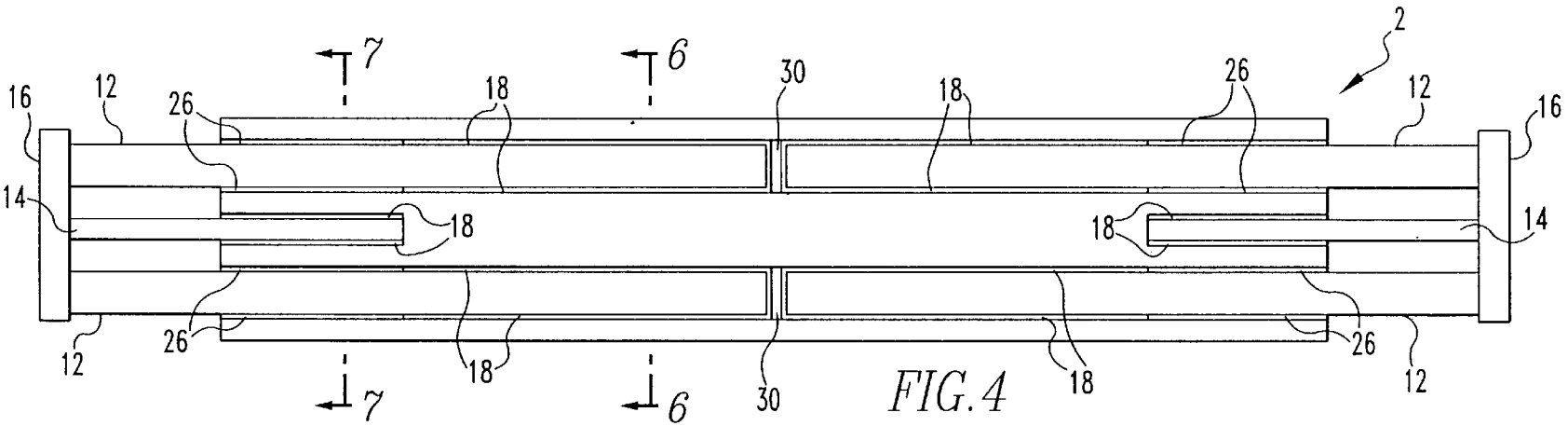
FIG. 4 is a plan view of the cathode assembly shown in FIG. 3
Figure 5:
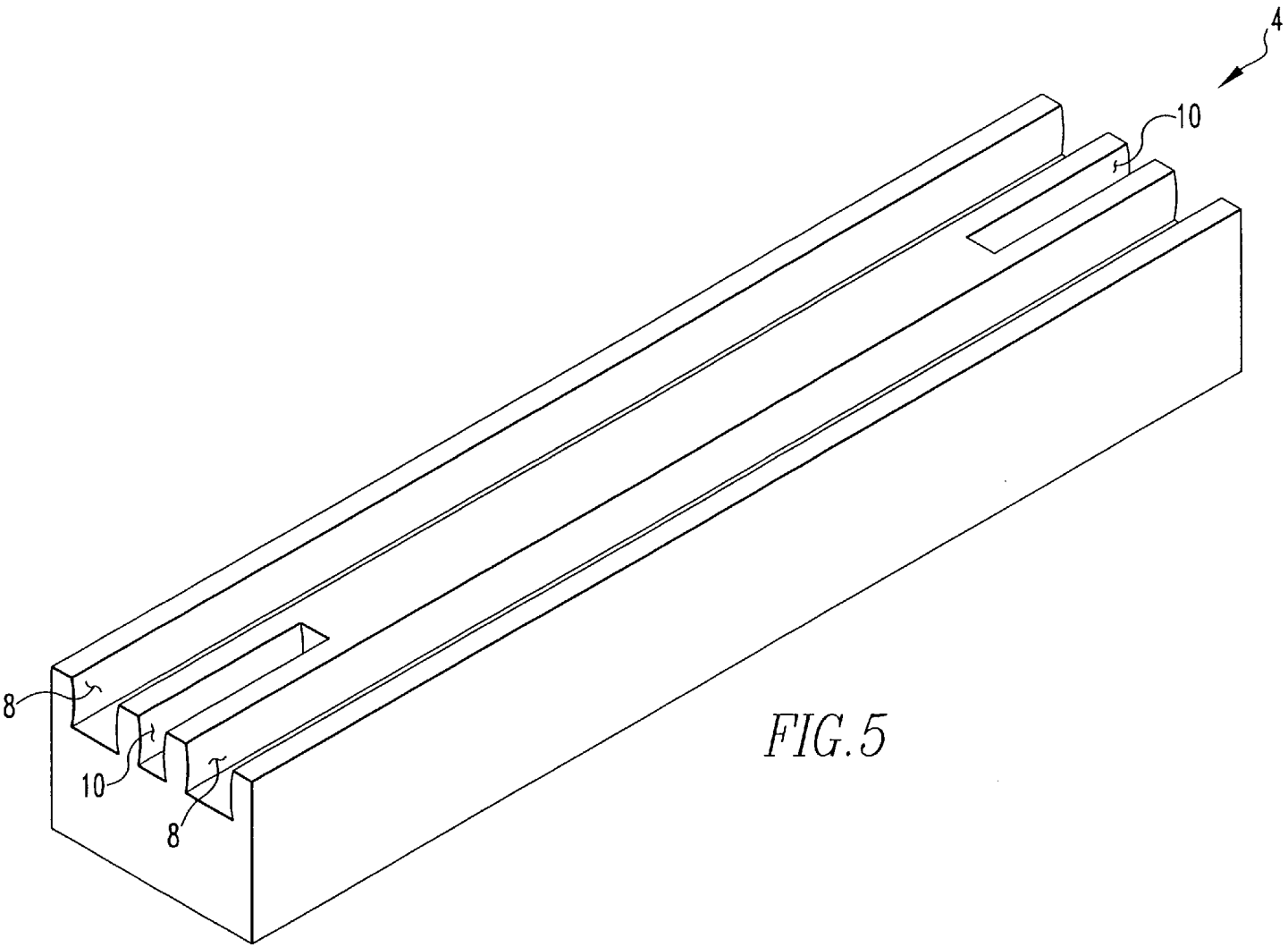
FIG. 5 is a perspective view of the cathode block shown in FIG. 3.

In the embodiment shown in FIG. 5, the cathode block 4 defines at least two first slots 8 extending between the external ends of the cathode block 4 and at least one second slot, preferably two second slots, 10 extending between one external end of the cathode block 4 and an interior portion of the cathode block 4. As shown in FIGS. 3 and 4, a primary collector bar 12 is received within each of the first slots 8 and a secondary collector bar 14 is received in each second slot 10. Each multi-piece collector bar assembly 6 includes two primary collector bars 12 and one secondary collector bar 14. The primary and secondary collector bars 12 and 14 extend out of the cathode block 4 and each has an exposed end which is connected to a common member 16 which in turn is connected to a bus bar in a conventional manner. In use, the exposed ends of the primary and secondary collector bars 12 and 14 and the common member 16 are positioned outside the chamber of an electrolytic cell and are connected via a bus bar (not shown) to a current supply in a conventional manner.

Each of the primary collector bars 12 have a primary interface for electrical connection to the cathode block 4 and the secondary collector bar 14 has a secondary interface for electrical connection to the cathode block 4. The electrical connection may be achieved by various mechanisms as described hereinafter. The combination of the primary interfaces taken together is sized to be larger than the secondary interface. In this manner, more surface area of electrical contact is achieved between the total of the primary collector bars 12 and the cathode block 4 than is achieved between the secondary collector bar 14 and the cathode block 4.

Figure 6:
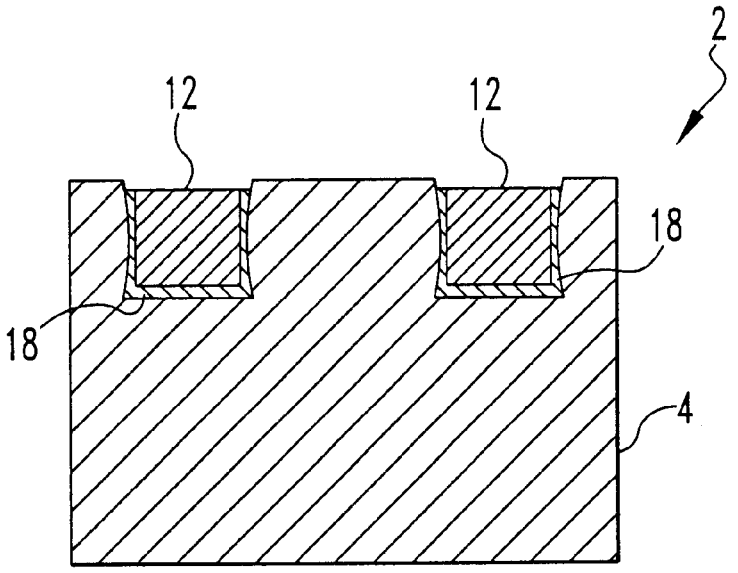
FIG. 6 is a cross-sectional view of the cathode assembly shown in FIG. 4 taken along line 6—6.
Figure 7:
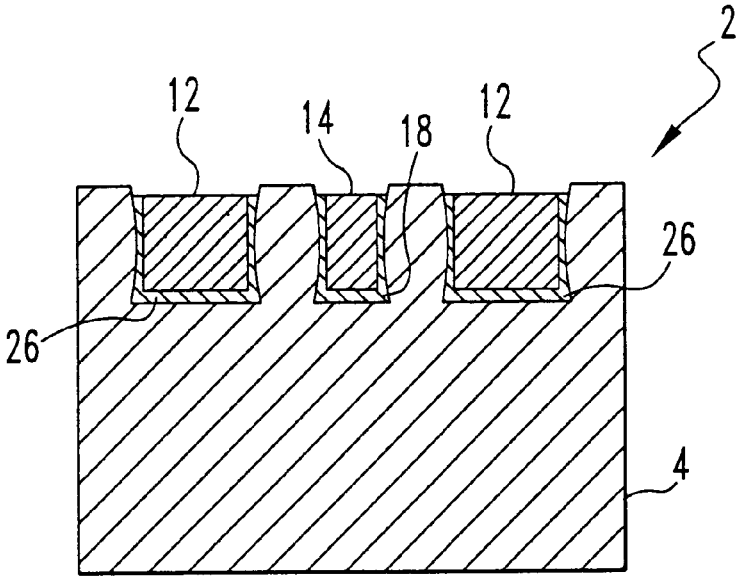
FIG. 7 is a cross-sectional view of the cathode assembly shown in FIG. 4 taken along line 7—7.

A preferred way of accomplishing this relative sizing of the combined primary interfaces and the secondary interface is shown in FIGS. 4, 6, and 7, wherein the primary collector bars 12 are larger than the secondary collector bars 14. By this it is meant that the cross-sectional area and/or length of the primary collector bars 12 is larger than that of the secondary collector bar 14. More preferably, the primary collector bars 12 each have a cross-sectional area which is at least as large as the cross-sectional area of the secondary collector bars 14, and the portion of the primary collector bars 12 received in the slots 8 are longer than the portion of the secondary collector bars 14 received in the slots 10.

The primary and secondary collector bars 12 and 14 have cross-sectional areas that are smaller than the cross-sectional areas of the corresponding first and second slots 8 and 10. To secure the primary and secondary collector bars 12 and 14 within the corresponding first and second slots 8 and 10, a layer 18 of an electrically conductive material is positioned between each of the primary collector bars 12 and the cathode block 4 and between the secondary collector bar 14 and the cathode block 4. In this embodiment, the layers 18 constitute the primary interface for electrical connection between the primary collector bars 12 and the cathode block 4 and the secondary interface between the secondary collector bars 14 and the cathode block 4. The electrically conductive layers 18 are preferably formed from cast iron, carbonaceous glue or rammed carbonaceous paste and electrically connect the cathode block 4 to the primary and secondary collector bars 12 and 14. However, only a connected portion 20 of the primary collector bars 12 is secured to the cathode block 4 via the electrically conductive layer 18 and is electrically connected thereto.

As shown in FIG. 3, connected portion 20 preferably extends between the end of the primary collector bar 12 adjacent the center of the cathode block 4 and a position, noted at reference numeral 22, between the center of the cathode block 4 and the end of the cathode block 4. The position 22 is selected to even out the current distribution along the length of the cathode block 4. When the connected portion 20 extends about one half of the length of the primary collector bar 12, the position 22 is at about two-thirds of the distance along the first slot 8 from the center of the cathode block 4. Referring to FIG. 4, non-electrically connected portions 24 of the primary collector bars 12 which are electrically disconnected from the cathode block 4 are insulated therefrom via a layer 26 of an insulating material between the non-electrically connected portion 24 and the cathode block 4. The insulating material may be refractory mortar or a fibrous insulating blanket or other suitable non-electrically conductive material. It is preferred that the position 22 at the end of the electrically connected portion 20 be aligned with the end of the secondary collector bar 14 in the direction transverse to the longitudinal axis of the cathode block 4. The secondary collector bar 14 is substantially fully secured with a layer of electrically conductive material 18; although a portion of the secondary collector bar 14 immediately adjacent the end of the cathode block 4 may not be secured to the cathode block 4 via the electrically conductive material.

It is believed that if the electrical connection from the cathode block 4 to the multi-piece collector bar assembly 6 is minimized at the ends of the cathode block 4, then the current will be forced to spread more evenly across the length of the cathode block 4 than occurs in conventional cathode assemblies. The present invention accomplishes this goal by selecting a combination of the primary interfaces between the primary collector bars 12 and the cathode block 4 which is larger than the secondary interface between the secondary collector bar 14 and the cathode block 4. More current will naturally flow to the larger combined primary interfaces than to the secondary interface. The amount of current passing through the external ends of the cathode block 4 is minimized by preventing current from passing through the external ends of the cathode block 4 to the primary collector bars 12 and yet allowing current to pass through the external ends of the cathode block 4 to the secondary collector bar 14. Accordingly, the cross-sectional area and length of each of the primary. and secondary collector bars 12 and 14 received in the first and second slots 8 and 10 as well as the relative sizes of the primary and secondary interfaces are each selected to provide uniform current distribution through the cathode assembly 2. The electrical current loading of the end of the cathode assembly 2 may be minimized despite the presence of the secondary collector bars 14 by using a smaller cross-sectional area for the secondary collector bar 14 than the cross-sectional area for the primary collector bars 12. In this manner, not all the current is excluded from passing through the external ends of the cathode block 4. A controlled amount of current is permitted to pass through cathode block 4 via the secondary collector bar 14 at the external ends of the cathode assembly 2 in order to even out the current distribution along the length of the cathode block 4.

In one embodiment of the invention, as best shown in FIGS. 6 and 7, the primary collector bars 12 have greater width than height. In this embodiment, the primary collector bars 12 of the present invention are about 150 mm wide and about 120 mm high and the secondary collector bars 14 are about 80 mm wide and about 120 mm high. Minimization of the height of the primary and secondary collector bars 12 and 14 allows the usable portion of the cathode block 4 above the collector bars 12 and 14 to be thicker (taller) with a corresponding extension in the wear life of the cathode block 4. These dimensions are exemplary only; other dimensions for the cathode assembly 2 are encompassed by the present invention. For example, it has been found that relatively wide primary bars 12 (described above) require that the cathode block 4 have relatively thin portions surrounding the slots 8 and 10, particularly at the outer longitudinal edge of the cathode block 4. These thin edges may be prone to cracking, hence other dimensions of the primary and secondary collector bars 12 and 14 may be more suitable in certain environments.

The embodiment shown in FIGS. 3 and 4 includes a cathode block 4 of the present invention defining two parallel spaced first slots 8 and a second slot 10 defined at each end of the cathode block 4 positioned between the first slots 8. This arrangement allows for the use of an opposing pair of multi-piece collector bar assemblies 6. Each slot 8 receives a pair of primary collector bars 12. The primary collector bars 12 in a single first slot 8 are maintained spaced apart via conventional filler material 30 as described hereinabove. This is not meant to be limiting, as the cathode assembly of the present invention includes other arrangements.

Figure 8:
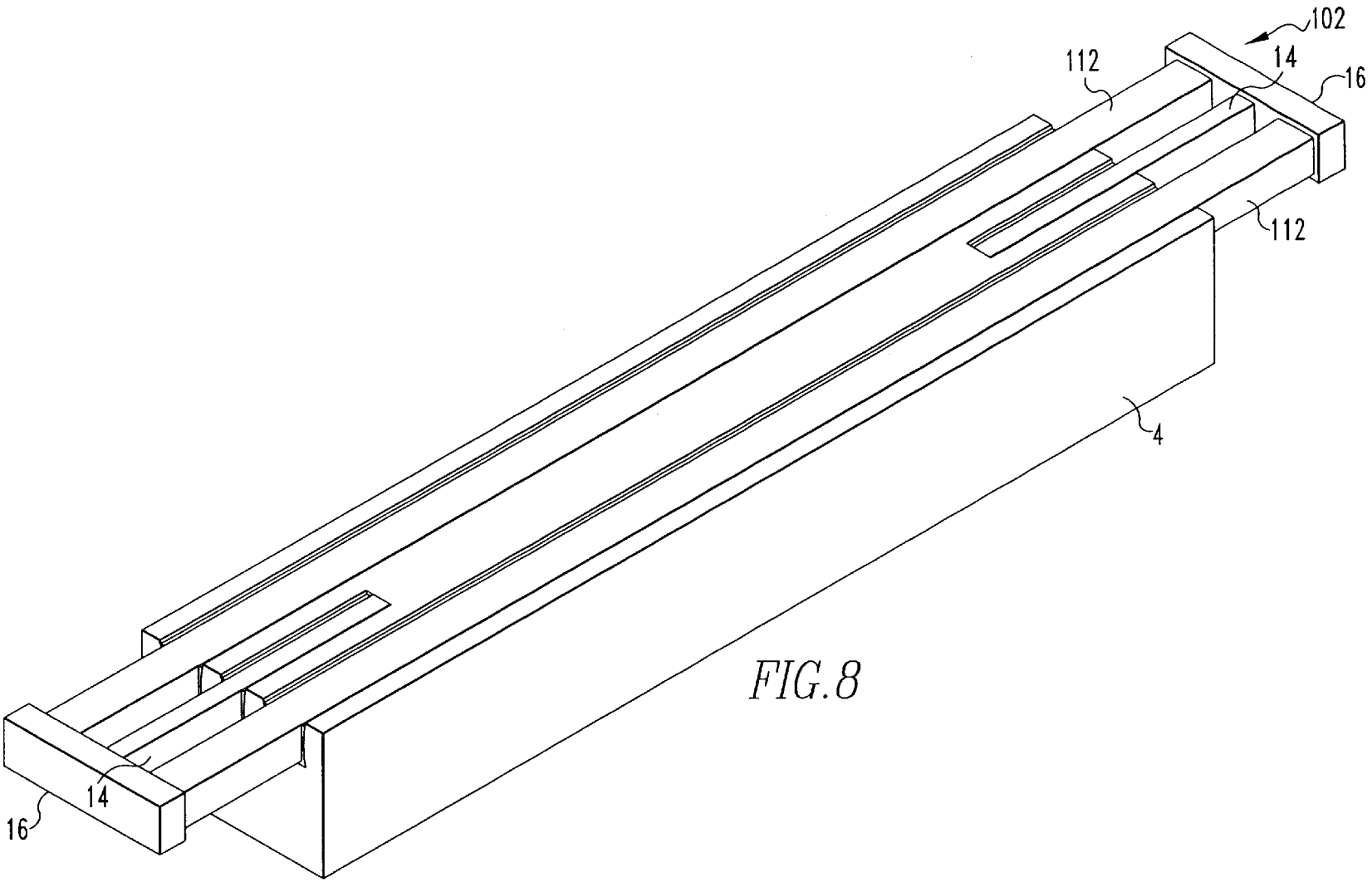
FIG. 8 is a perspective view of a second embodiment of a cathode assembly made in accordance with the present invention.

For example, in a second embodiment of the invention shown in FIG. 8, a cathode assembly 102 includes primary collector bars 112 which extend the full length of the cathode block 4. Alternatively, a single secondary collector bar (not shown) may be used which likewise extends the full length of the cathode block.

Figure 9:
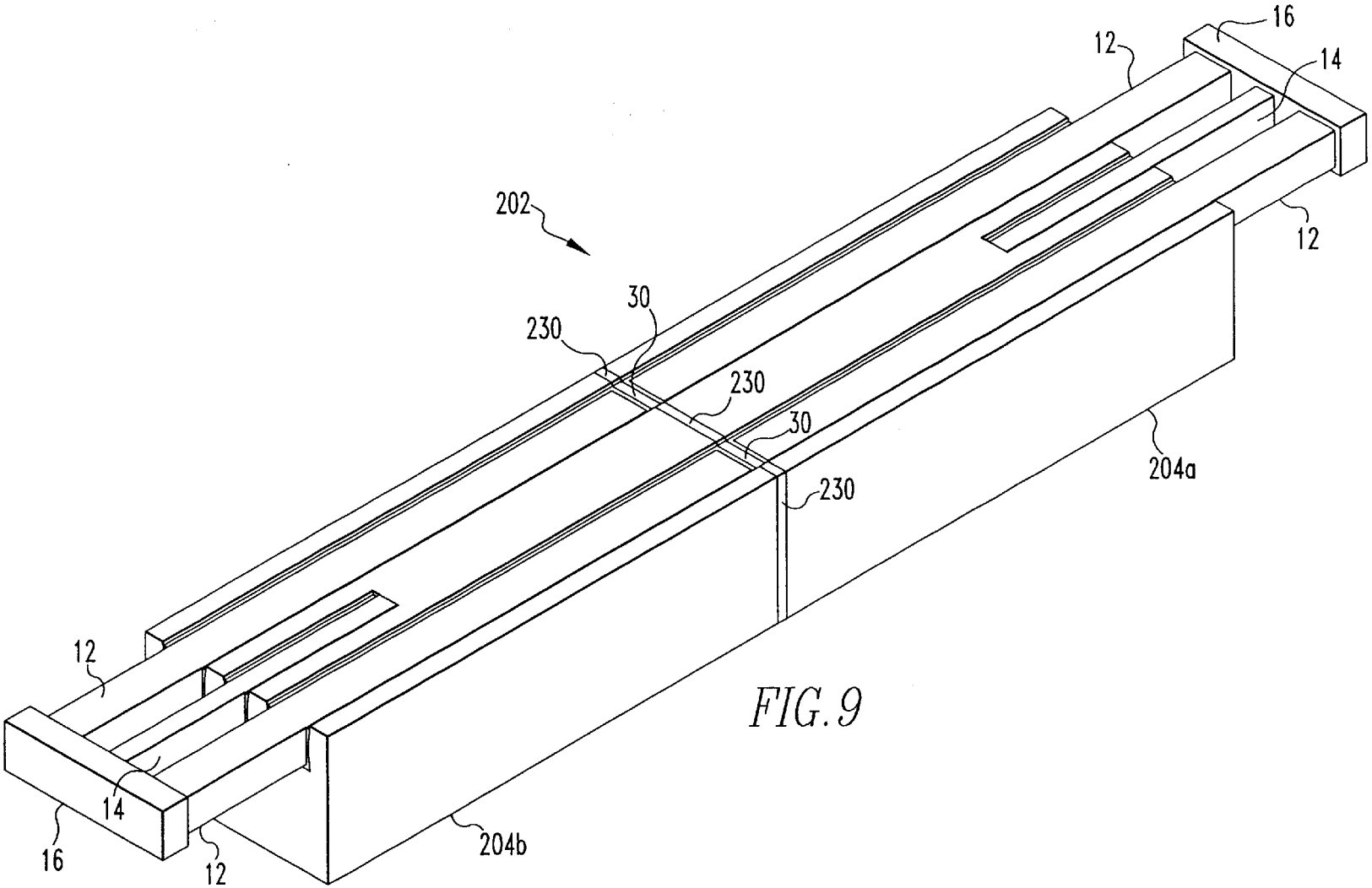
FIG. 9 is a perspective view of a third embodiment of a cathode assembly made in accordance with the present invention.
Figure 10:
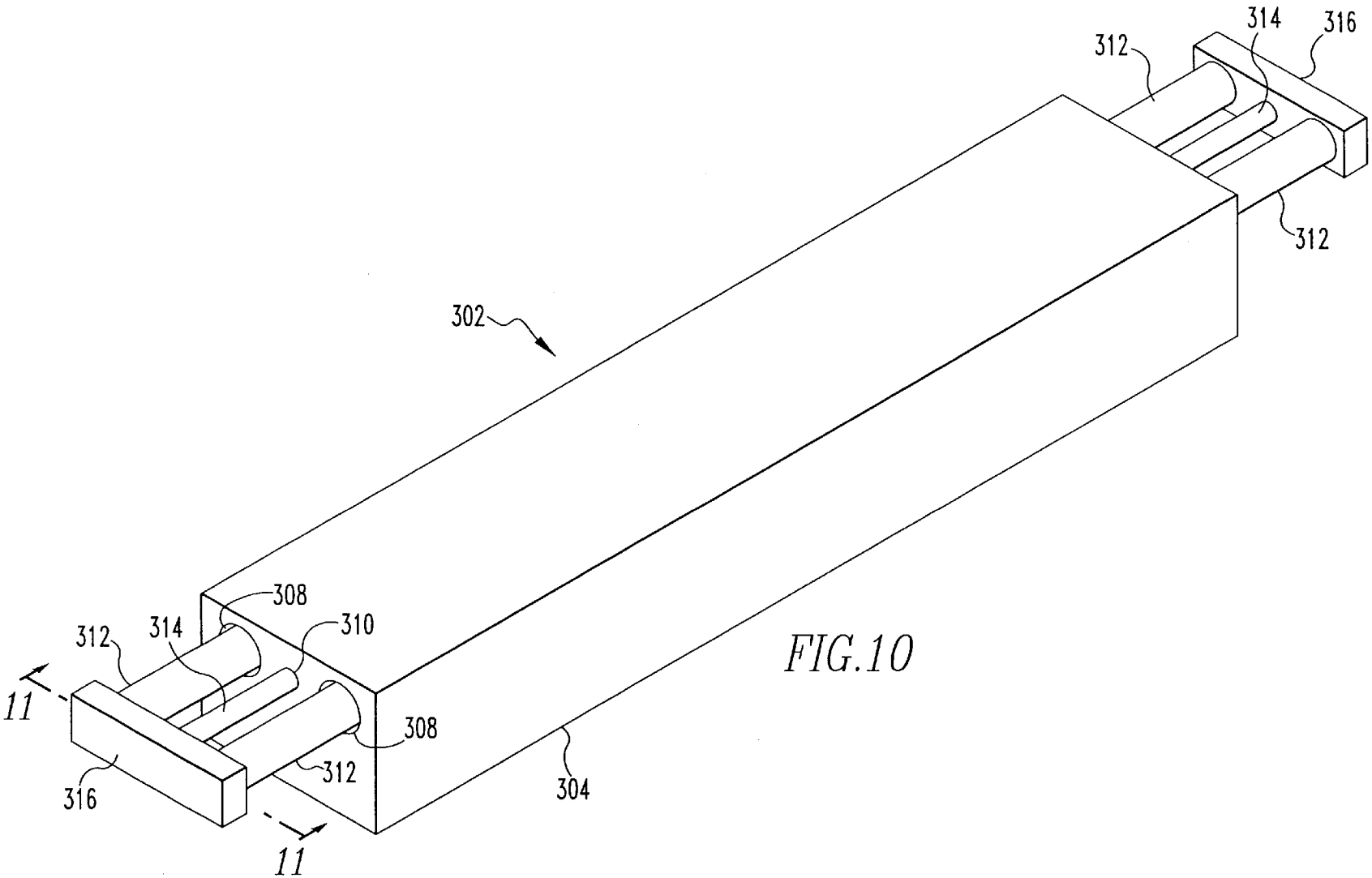
FIG. 10 is a perspective view of a fourth embodiment of a cathode assembly made in accordance with the present invention.
Figure 11:
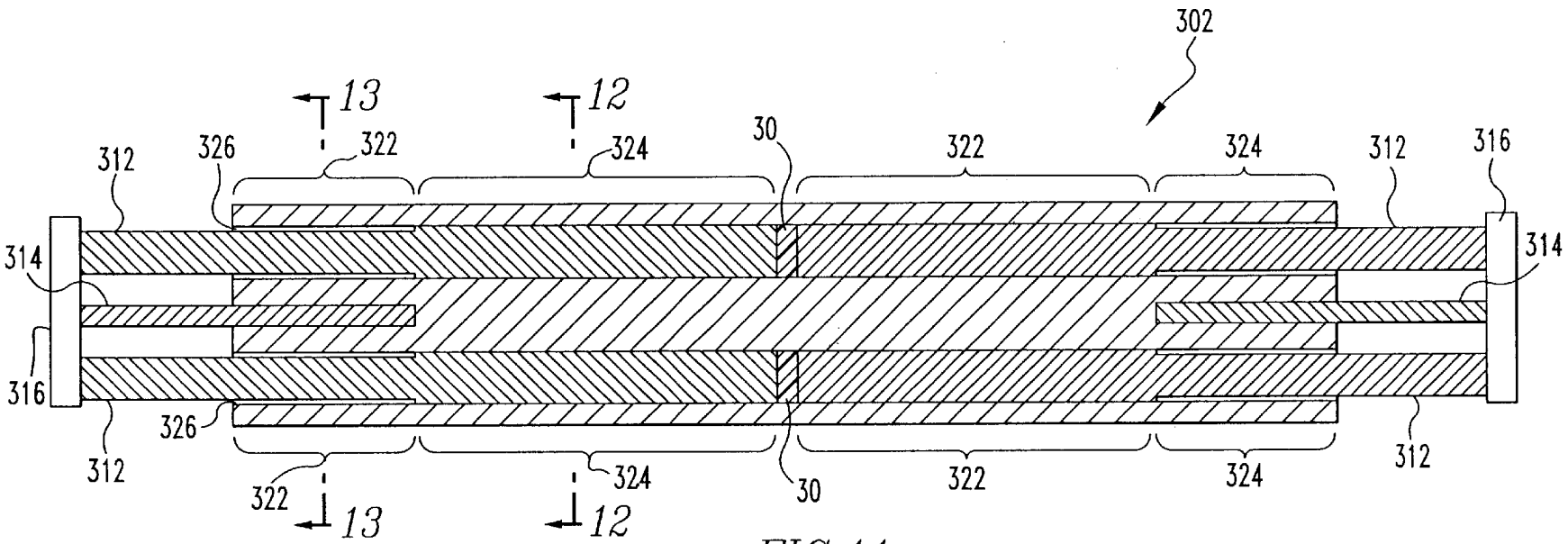
FIG. 11 is a cross-sectional view of the cathode assembly shown in FIG. 10 taken along line 11—11.
Figure 12:
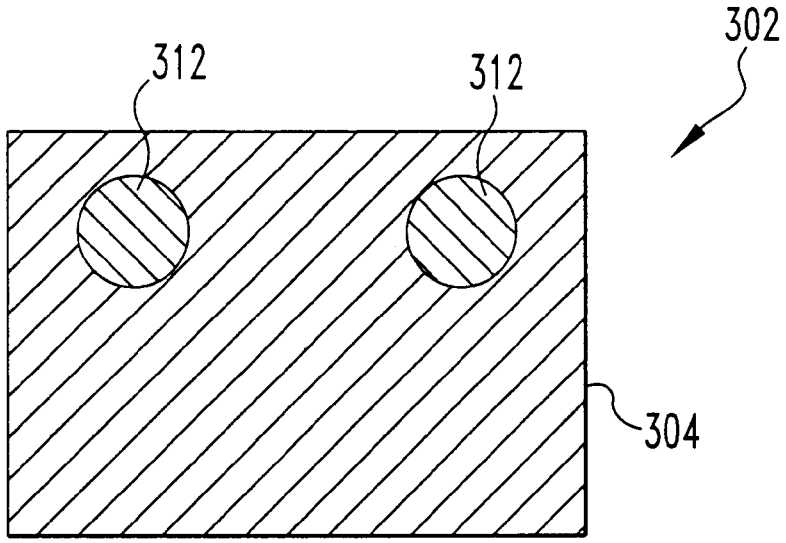
FIG. 12 is a cross-sectional view of the cathode assembly shown in FIG. 11 taken along line 12—12.
Figure 13:
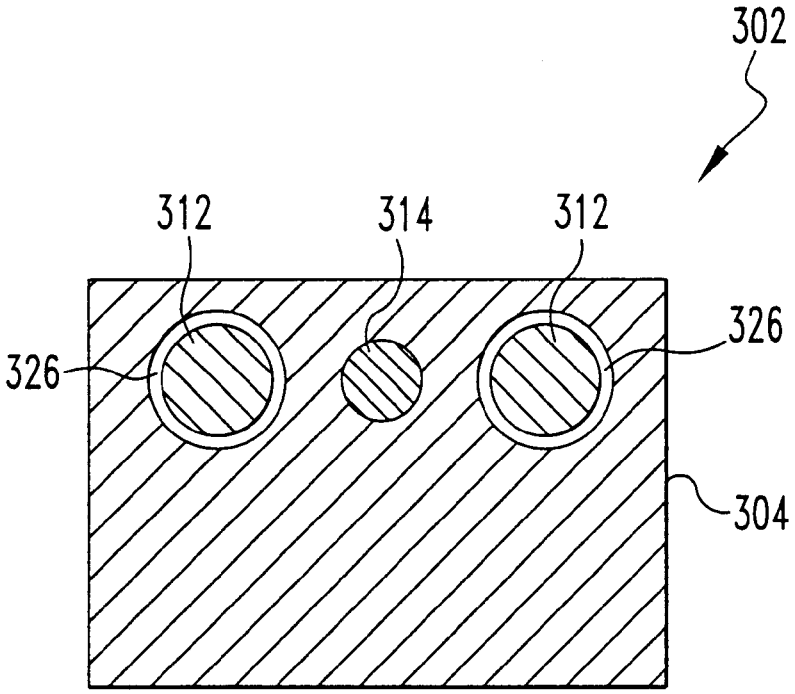
FIG. 13 is a cross-sectional view of the cathode assembly shown in FIG. 11 taken along line 13—13.

In a third embodiment shown in FIG. 9, a cathode assembly 202 includes a split cathode block formed from block 204*a* and block 204*b* with a layer 230 of seam mix or ramming paste therebetween. The split cathode blocks 204*a* and 204*b* each receive a pair of primary collector bars 12 and a secondary collector bar 14. Filler material 36 is positioned between the ends of the primary collector bars 12 and the layer 230 and the primary collector bar 12 in each of the blocks 204*a* and 204*b*. Additionally, in each of the above-described embodiments, the electrically conductive material which connects the collector bars to the cathode block may also be positioned at spaced apart locations along the length of the slots.

The above-described embodiments each utilize some sort of electrically conductive material positioned between the cathode blocks and the primary and secondary collector bars. In a fourth embodiment of the invention, it is also possible to avoid the use of an electrically conductive material in the slots of the cathode block by fitting the connected portion of the primary collector bar and substantially all of the secondary collector bar within the slots.

This fourth embodiment, cathode assembly 302, is shown in FIGS. 10–13. The cathode assembly 302 includes a cathode block 304 in which the slots are defined therein as bores 308 and 310. Preferably, the bores 308 and 310 each have a circular cross section. A primary collector bar 312 is received within each bore 308 and a secondary collector bar 314 is received in each bore 310. The primary and secondary collector bars 312 and 314 are preferably also circular in cross-section. Similar to the first three embodiments, the primary collector bars 312 each include a connected portion 322 and an unconnected portion 324. The connected portion is electrically connected to the cathode block 304 by sizing the connected portion 322 to fit within the bore 308. Upon heating of the cathode assembly 302 during use, the primary collector bar 312 expands to ensure electrical contact with the cathode block 304 along the connected portion 322. The bore 308 includes an enlarged diameter portion creating a gap 326. The gap 326 is sized so that no electrical contact is made between the unconnected portion 324 and the cathode block 304. Substantially all of the secondary collector bar 314 is fitted within the bore 310 and likewise expands upon use to ensure electrical connection to the cathode block 304. The cathode assembly 304 may also be modified by using different geometries for the bores and the collector bars and by using a split cathode block or full-length primary collector bars as described above with regard to the other embodiments of the invention.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. In an electrolytic cell for the production of aluminum comprising a shell defining a chamber and an anode received in the chamber, the improvement comprising:

a cathode block positioned in the chamber below the anode, the cathode block defining at least two first slots and at least one second slot;

at least two primary collector bars, each primary collector bar being received in one of said first slots and having a primary interface for electrical connection to said cathode block; and at least one secondary collector bar being received in said second slot and having a secondary interface for electrical connection to said cathode block, wherein a combination of said at least two primary interfaces is larger than said secondary interface.

2. The electrolytic cell as claimed in claim 1, wherein said primary interface includes a connected portion of an exterior surface of said primary collector bar, said connected portion being electrically connected to said cathode block such that current may pass from said cathode block to said connected portion during operation of the cell and further wherein an unconnected portion of said primary collector bar exterior surface is electrically disconnected from said cathode block.

3. The electrolytic cell as claimed in claim 2, wherein said connected portion of said primary collector bar exterior surface is positioned adjacent an interior portion of said cathode block and said unconnected portion of said primary collector bar exterior surface is positioned adjacent an external end of said cathode block.

4. The electrolytic cell as claimed in claim 2, wherein said secondary interface includes an exterior surface of said secondary collector bar which extends substantially the length of said second slot and is electrically connected to said cathode block.

5. The electrolytic cell as claimed in claim 4, further comprising a layer of an electrically conductive material positioned on said connected portion of said primary collector bar exterior surface and a layer of an electrically conductive material positioned on said secondary collector bar exterior surface.

6. The electrolytic cell as claimed in claim 5 further comprising a nonelectrically conductive filler material disposed in each said first slot along said unconnected portion of said primary collector bar exterior surface.

7. The electrolytic cell as claimed in claim 2, wherein said connected portion extends along about two-thirds of the length of said first slot.

8. The electrolytic cell as claimed in claim 1, wherein said secondary collector bar is positioned between said primary collector bars.

9. A cathode assembly configured for use in an Hall-Heroult electrolytic cell for the production of aluminum, said assembly comprising:

a cathode block defining at least two first slots and at least one second slot;

at least two primary collector bars, each primary collector bar being received in one of said first slots and having a primary interface for electrical connection to said cathode block; and at least one secondary collector bar being received in said second slot and having a secondary interface for electrical connection to said cathode block, wherein a combination of said at least two primary interfaces is larger than said secondary interface.

10. The cathode assembly as claimed in claim 9, wherein said first and second slots are defined in a lower surface of said cathode block.

11. The cathode assembly as claimed in claim 9, wherein said first and second slots each comprise a bore defined in said cathode block.

12. The cathode assembly as claimed in claim 9 wherein said primary collector bars each have a cross-sectional area which is at least as great as a cross-sectional area of said secondary collector bar.

13. The cathode assembly as claimed in claim 9, wherein said primary interface includes a connected portion of an exterior surface of said primary collector bar which is electrically connected to said cathode block and further wherein an unconnected portion of said primary collector bar exterior surface is electrically disconnected from said cathode block, such that when current is applied to said cathode block, the current passes from said cathode block to said connected portion.

14. The cathode assembly as claimed in claim 13, wherein said connected portion of said primary collector bar exterior surface is positioned adjacent an interior portion of said cathode block and said unconnected portion of said primary collector bar exterior surface is positioned adjacent an external end of said cathode block.

15. The cathode assembly as claimed in claim 14, wherein said secondary interface includes an exterior surface of said secondary collector bar which extends substantially the length of said second slot and is electrically connected to said cathode block such that when current is applied to said cathode block, the current passes from said cathode block to said secondary collector bar.

16. The cathode assembly as claimed in claim 15, further comprising a layer of an electrically conductive material positioned on said connected portion of said primary collector bar exterior surface and a layer of an electrically conductive material positioned on said secondary collector bar exterior surface.

17. The cathode assembly as claimed in claim 16 further comprising a nonelectrically conductive filler material disposed in each said first slot along said unconnected portion of said primary collector bar exterior.

18. The cathode assembly as claimed in claim 17, wherein said connected portion extends about two-thirds of the length of said first slot.

19. The cathode assembly as claimed in claim 9, wherein said secondary collector bar is positioned between said primary collector bars.

20. The cathode assembly as claimed in claim 9, wherein each said primary collector bar has a width greater than a height.

21. A method of producing aluminum in a cell having a chamber containing an electrolytic bath and an anode suspended in the bath, said method comprising:

providing a cathode assembly in the chamber below the anode, the cathode assembly having (1) a cathode block having an external end, the cathode block defining at least two first slots and at least one second slot; (2) at least two primary collector bars, each primary collector bar being received in one of the first slots and having a primary interface for electrical connection to the cathode block and (3) at least one secondary collector bar being received in the second slot and having a secondary interface for electrical connection to the cathode block, wherein a combination of the at least two primary interfaces is larger than the secondary interface; and passing an electric current from the anode to the cathode assembly, thereby controlling the amount of current passing to the primary collector bars relative to the amount of current passing to the secondary collector bar.

22. The method as claimed in claim 21 wherein said step of passing an electric current from the anode to the cathode assembly further comprises passing the current from the anode to only a connected portion of an exterior surface of the primary collector bars adjacent an interior of the cathode block and to substantially all of an exterior surface of the secondary collector bar.

23. The method as claimed in claim 22 further comprising: electrically connecting substantially all of the exterior surface of the secondary collector bar to the cathode block; and electrically connecting the connected portion of the exterior surface of the primary collector bars to the cathode block, such that current is prevented from passing from the cathode block to the exterior surfaces of the primary collector bars located adjacent the external end of the cathode block.

* * * * *